US008123498B2

(12) United States Patent
Deffenbaugh et al.

(10) Patent No.: US 8,123,498 B2
(45) Date of Patent: Feb. 28, 2012

(54) TUNABLE CHOKE TUBE FOR PULSATION CONTROL DEVICE USED WITH GAS COMPRESSOR

(75) Inventors: Danny Deffenbaugh, San Antonio, TX (US); Robert McKee, San Antonio, TX (US); Marybeth Nored, San Antonio, TX (US)

(73) Assignee: Southern Gas Association Gas Machinery Research Council, Dallas, TX (US)

( * ) Notice: Subject to any disclaimer, the term of this patent is extended or adjusted under 35 U.S.C. 154(b) by 201 days.

(21) Appl. No.: 12/019,462

(22) Filed: Jan. 24, 2008

(65) Prior Publication Data

US 2009/0191076 A1 Jul. 30, 2009

(51) Int. Cl.
*F04B 39/00* (2006.01)
*F01N 1/16* (2006.01)
*F01N 13/08* (2006.01)

(52) U.S. Cl. ..... 417/312; 181/241; 181/254

(58) Field of Classification Search ..... 417/53, 417/312; 181/197, 215, 241, 254
See application file for complete search history.

(56) References Cited

U.S. PATENT DOCUMENTS

| | | | | |
|---|---|---|---|---|
| 2,198,021 | A | 4/1940 | Wood | |
| 2,501,751 | A * | 3/1950 | Aldridge | 137/565.34 |
| 2,570,241 | A | 10/1951 | Hutchinson | |
| 2,919,715 | A | 1/1960 | Rockwell | |
| 2,951,638 | A | 9/1960 | Hughes et al. | |
| 2,973,132 | A | 2/1961 | Hirsch | |
| 3,114,430 | A * | 12/1963 | Gallagher | 181/254 |
| 3,181,648 | A * | 5/1965 | Bottum | 181/277 |
| 3,219,141 | A * | 11/1965 | Williamitis | 181/269 |
| 3,884,596 | A | 5/1975 | Hoffmeister | |
| 3,936,606 | A | 2/1976 | Wanke | |
| 3,940,721 | A | 2/1976 | Kojima et al. | |
| 4,359,134 | A | 11/1982 | Jackson | |
| 4,523,612 | A | 6/1985 | Kuklo | |
| 4,557,349 | A | 12/1985 | Crump | |
| 4,570,745 | A | 2/1986 | Sparks et al. | |
| 4,658,634 | A * | 4/1987 | Killough et al. | 73/1.28 |
| 4,779,415 | A | 10/1988 | Richardson | |
| 4,927,342 | A | 5/1990 | Kim et al. | |
| 5,119,427 | A | 6/1992 | Hersh et al. | |

(Continued)

FOREIGN PATENT DOCUMENTS

JP 2004037313 2/2004

(Continued)

OTHER PUBLICATIONS

White, Mechanical Modeling of Compressor Manifold Systems, Reprinted from Compressor Tech Two Magazine, Southwest Research Institute, 12 pages, 2006.

(Continued)

*Primary Examiner* — Devon C Kramer
*Assistant Examiner* — Nathan Zollinger
(74) *Attorney, Agent, or Firm* — Peter V. Schroeder; Booth Albanesi Schroeder LLC

(57) ABSTRACT

A method and system for reducing pulsation in a gas compressor system. A pulsation control device, such as a filter bottle or side branch absorber, is installed at a port into some location on the compressor system. The pulsation control device has a choke tube with a variable cross-sectional area, such as by having multiple conduits that may be opened or closed or a diameter that may be varied. In operation, the cross sectional area of the choke tube is varied depending on the compressor speed.

6 Claims, 10 Drawing Sheets

U.S. PATENT DOCUMENTS

| | | | | |
|---|---|---|---|---|
| 5,189,266 | A | 2/1993 | Sasaki et al. | |
| 5,203,679 | A | 4/1993 | Yun | |
| 5,288,212 | A | 2/1994 | Lee | |
| 5,377,629 | A | 1/1995 | Brackett et al. | |
| 5,471,400 | A | 11/1995 | Smalley | |
| 5,621,656 | A | 4/1997 | Langley | |
| 5,760,349 | A | 6/1998 | Borchers | |
| 5,866,860 | A * | 2/1999 | Chen | 181/237 |
| 5,930,371 | A | 7/1999 | Cheng et al. | |
| 6,012,908 | A | 1/2000 | Tanaka et al. | |
| 6,152,703 | A | 11/2000 | Yoshimura et al. | |
| 6,295,363 | B1 | 9/2001 | Laake et al. | |
| 6,453,695 | B1 | 9/2002 | Marks et al. | |
| 6,533,064 | B1 | 3/2003 | Kim et al. | |
| 6,546,729 | B2 | 4/2003 | Hellat et al. | |
| 6,634,457 | B2 | 10/2003 | Paschereit et al. | |
| 6,698,390 | B1 | 3/2004 | Kostun et al. | |
| 6,792,907 | B1 | 9/2004 | Kostun et al. | |
| 6,799,657 | B2 | 10/2004 | Daniels | |
| 6,814,041 | B1 | 11/2004 | Cheng et al. | |
| 6,935,848 | B2 | 8/2005 | Marshall et al. | |
| 7,055,484 | B2 | 6/2006 | Marks et al. | |
| 7,246,680 | B2 | 7/2007 | Osterkamp | |
| 7,299,894 | B2 | 11/2007 | Kawahashi et al. | |
| 7,337,877 | B2 | 3/2008 | Goenka et al. | |
| 2002/0059959 | A1 | 5/2002 | Oatu et al. | |
| 2003/0136119 | A1 | 7/2003 | Marks et al. | |
| 2004/0065303 | A1 | 4/2004 | Russell | |
| 2005/0008512 | A1 | 1/2005 | McGill | |
| 2005/0111997 | A1 | 5/2005 | Smith et al. | |
| 2005/0194207 | A1 | 9/2005 | Nemit et al. | |
| 2006/0275158 | A1 | 12/2006 | Nagao et al. | |
| 2007/0101706 | A1 | 5/2007 | Harris et al. | 60/312 |
| 2007/0130926 | A1 | 6/2007 | Jett | |
| 2007/0289653 | A1 | 12/2007 | Harris et al. | 138/30 |
| 2008/0023264 | A1 * | 1/2008 | Pacini et al. | 181/237 |
| 2008/0253900 | A1 | 10/2008 | Harris et al. | |
| 2010/0193283 | A1 | 8/2010 | Vaz | |

FOREIGN PATENT DOCUMENTS

| | | |
|---|---|---|
| WO | WO0144681 | 6/2001 |
| WO | WO2006030559 | 3/2006 |
| WO | WO 2007135521 A2 * | 11/2007 |

OTHER PUBLICATIONS

U.S. Appl. No. 11/734,116, filed Apr. 11, 2007, Harris et al.

Bedout et al. "Adaptive-Passive Noise Control With Self-Tuning Helmholtz Resonators", Journal of Sound and Vibration 202(1), pp. 109-123, 1997.

Deffenbaugh et al., "Compression Technology for the Next Generation", Technology Today, pp. 14-18, Winter 2005.

Esteve et al., "Adaptive Helmholtz Resonators and Passive Vibration Absorbers for Cylinder Interior Noise Control", Journal of Sound and Vibration, www.sciencedirect.com, 22 pages, Jan. 25, 2005.

* cited by examiner

TUNABLE CHOKE TUBE FOR PULSATION CONTROL DEVICE USED WITH GAS COMPRESSOR

TECHNICAL FIELD OF THE INVENTION

This invention relates to reciprocating compressors for transporting natural gas, and more particularly to an improved method for controlling pulsations in the piping system associated with such compressors.

BACKGROUND OF THE INVENTION

To transport natural gas from production sites to consumers, pipeline operators install large compressors at transport stations along the pipelines. Natural gas pipeline networks connect production operations with local distribution companies through thousands of miles of gas transmission lines. Typically, reciprocating gas compressors are used as the prime mover for pipeline transport operations because of the relatively high pressure ratio required. Reciprocating gas compressors may also be used to compress gas for storage applications or prior to transport in processing plant applications.

Reciprocating gas compressors are a type of compressor that compresses gas using a piston in a cylinder connected to a crankshaft. The crankshaft may be driven by an electric motor. A suction valve in the compressor cylinder receives input gas, which is then compressed by the piston and discharged through a discharge valve.

Reciprocating gas compressors inherently generate transient pulsating flows because of the piston motion and alternating valve motion. Various devices and control methods have been developed to control these pulsations. An ideal pulsation control design reduces system pulsations to acceptable levels without compromising compressor performance.

A common method for pulsation control is the use of "filter bottles", also called "pulsation filters", placed between the compressor and the pipeline headers. These filters are typically implemented as volume-choke-volume devices. They function as low-pass acoustic filters, and attenuate pulsations on the basis of a predetermined Helmholtz response.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to various embodiments of pulsation control devices that are used with a compressor system and that have "tunable" choke tubes. As explained below, the pulsation control device may have an internal or external choke tube. The choke tube diameter may be effectively variable in the sense that the choke tube has multiple conduits that can be selectively opened and closed. Alternatively, the choke tube may have a single conduit, but may be made from a material or otherwise designed so that the conduit's cross-sectional area is capable of changing along its length. For purposes of this description, these choke tubes are deemed to have a "variable cross section", whether by means of using multiple conduits or by actually varying the diameter of a single conduit.

Two types of pulsation control devices are described herein. The first type is a filter bottle, which is a "flow through" device. The second type is a side branch absorber (SBA), which may be placed at various locations along the path of the gas within the compressor system including its lateral piping. Examples of SBA's used with compressor systems are described in U.S. Patent Pub. Nos. 2007/0289653 and 2007/0101706 and in U.S. patent application Ser. No. 11/734,116, all incorporated herein by reference.

Figure 1:
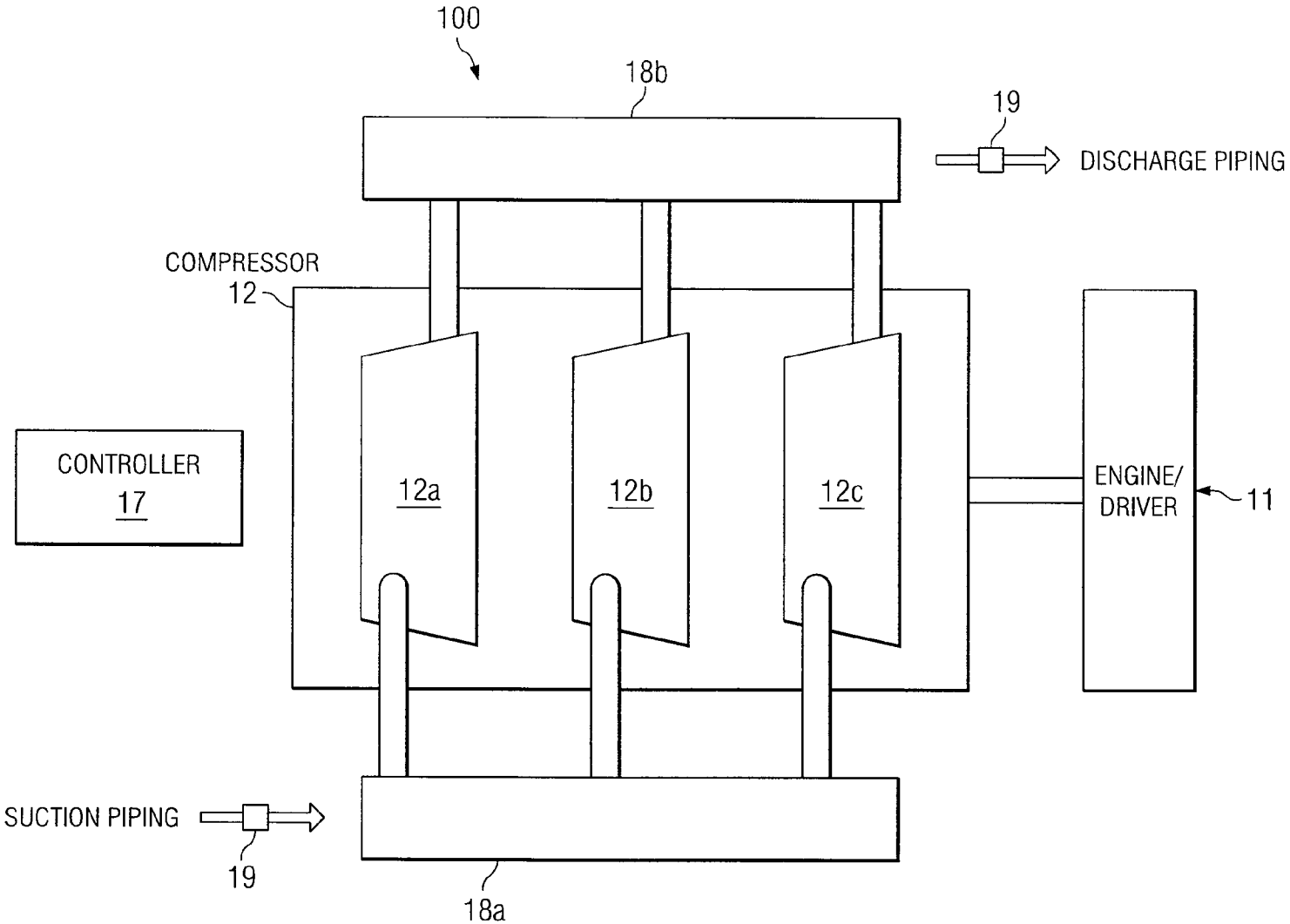
FIG. 1 is a block diagram of a "generic" reciprocating gas compressor system.

FIG. 1 is a block diagram of the basic elements of a typical ("generic") reciprocating gas compressor system 100. Compressor system 100 has a driver 11, compressor 12, suction filter bottle 18*a*, discharge filter bottle 18*b*, suction and discharge piping connections 19, and a controller 17.

In the example of FIG. 1, compressor 12 has three compressor cylinders 12*a*-12*c*. In practice, compressor 12 may have fewer or more (often as many as six) cylinders. Further, it may have either an integral or separate engine or motor driver 11.

The following description is written in terms of the "generic" compressor system 100. However, the same concepts are applicable to other compressor configurations.

A typical application of compressor system 100 is in the gas transmission industry. The compressor system 100 operates between two gas transmission lines. The first line, at an initial pressure, is referred to as the suction line. The second line, at the exit pressure for the station, is referred to as the discharge line. The suction and discharge lines are also referred to in the industry as the "lateral piping". The pressure ratio (discharge pressure divided by suction pressure) may vary between 1.25-4.0, depending on the pipeline operation requirements and the application.

As explained in the Background, filter bottles 18*a* and 18*b* are used to reduce compressor system pulsations. These filter bottles are placed between the compressor and the lateral piping, on the suction or discharge side or on both sides. The effectiveness of filters of this type is dependent on the pulsation frequencies that need to be controlled due to the speed of the compressor. Tunable choke tubes used in connection with filter bottles are described below in connection with FIGS. 2-6.

Although not shown in FIG. 1, compressor system 100 may also have any number of side branch absorbers in various locations. Tunable choke tubes used in connection with side branch absorbers are described below in connection with FIGS. 7-10.

Controller 17 is used for control of parameters affecting compressor load and capacity. The pipeline operations will vary based on the flow rate demands and pressure variations. The compressor must be capable of changing its flow capacity and load according to the pipeline operation. As explained below, the controller may include control circuitry and programming for controlling choke tubes associated with filter bottles 18*a* and 18*b*.

Tunable Choke Tube for Filter Bottles

Figure 2:
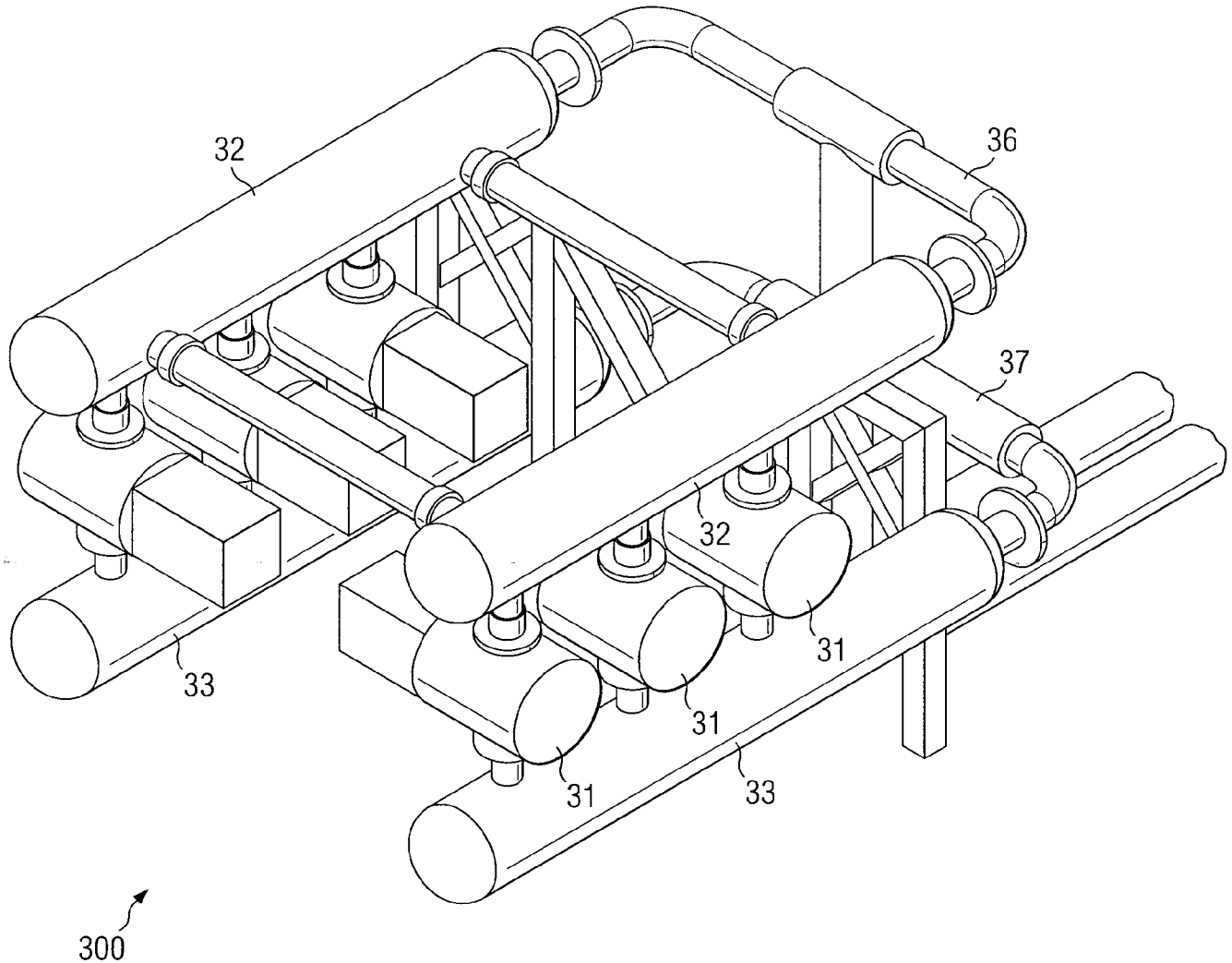
FIG. 2 is a perspective view of the cylinders and pulsation filter bottles (suction side and discharge side) of a six-cylinder reciprocating gas compressor.

FIG. 2 is a partial perspective view of a six-cylinder reciprocating gas compressor 300, showing its cylinders and filter bottles. Each set of three cylinders 31 is connected to both a suction-side pulsation filter bottle 32 and a discharge-side pulsation filter bottle 33. The suction piping 36 and discharge piping 37 are also shown.

Pulsation filter bottles 32 and 33 are "internal choke tube" filter bottles. As explained below, the filter bottles have two or more internal chamber volumes, separated by baffles. Each pair of chamber volumes is connected with an internal choke tube for carrying gas from one chamber to the other.

Figure 3:
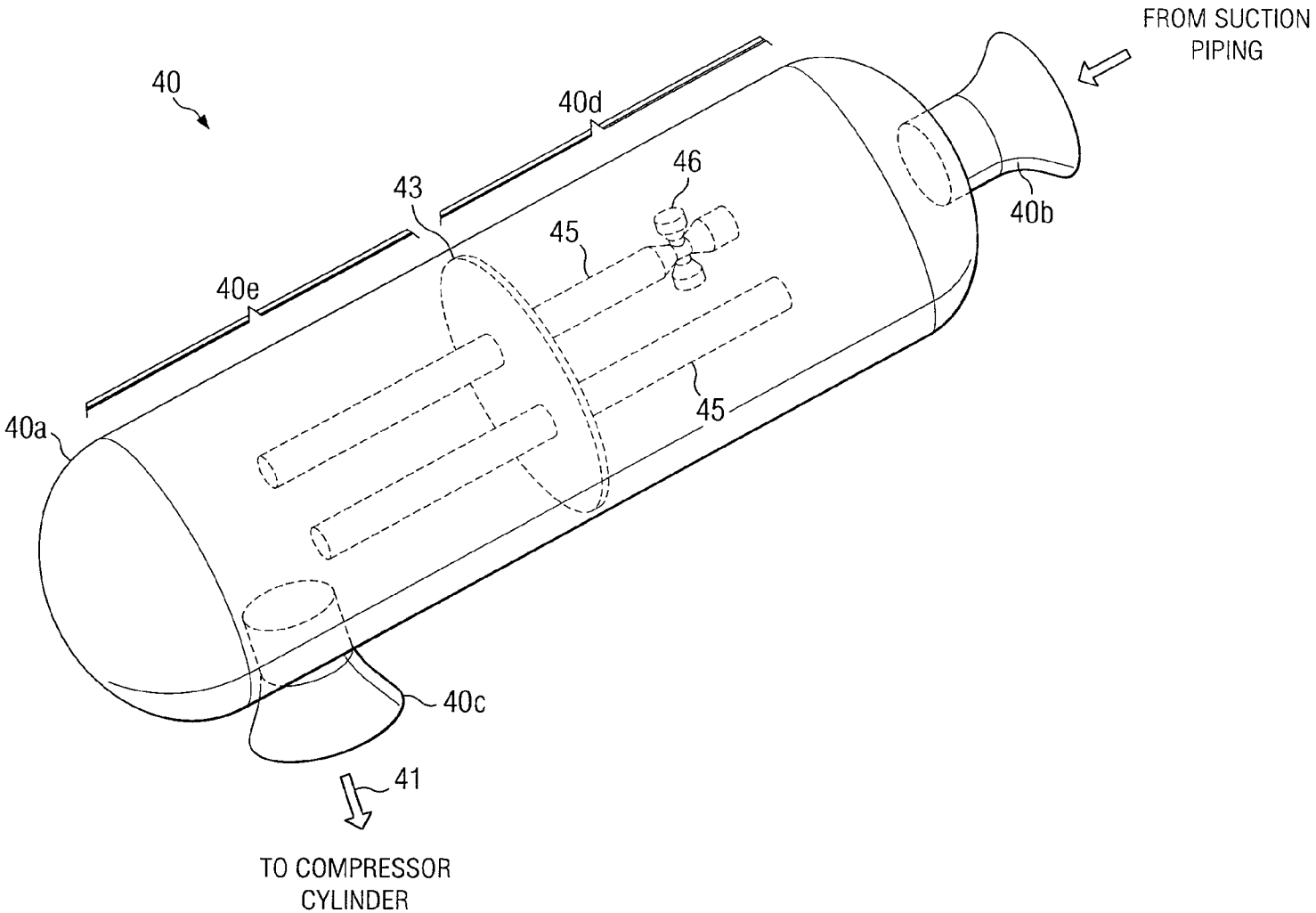
FIG. 3 illustrates the internal elements of a filter bottle having a multi-conduit internal choke tube.

FIG. 3 illustrates the internal elements of a pulsation filter bottle 40 having an internal choke tube 45. In the example of FIG. 3, filter bottle 40 is a suction-side filter bottle 40, like the bottle 32 of FIG. 2. In other words, bottle 40 is installed between the suction piping and the cylinder intake. However, the concepts described herein also may be applied to a discharge-side pulsation filter bottle.

In the example of FIG. 3, the filter bottle 40 operates in conjunction with a single cylinder, and has two volumes separated by a tunable (two-conduit) choke tube 45. As explained below in connection with FIG. 6, in practice, for a multi-cylinder compressor, a typical filter bottle serves multiple cylinders and has multiple primary volumes that are connected with individual choke tubes to a single secondary volume.

Filter bottle 40 has a rigid external shell 40*a*. In the embodiment of FIG. 3, where bottle 40 is a suction-side bottle, port 40*b* receives gas from the suction piping. A second port 40*c* delivers gas into the compressor cylinder.

Filter bottle 40 has two chamber volumes 40*d* and 40*e* separated by a baffle 43. Choke tube 45 has a plurality of conduits, which permit the two volumes to be in fluid communication. In the example of this description, choke tube 45 has two conduits, but the concepts described herein could be extended to any number of choke tube conduits. The conduits of choke tube 45 may be, but are not necessarily, the same length.

Conventionally, pulsation filter bottles have a single-conduit choke tube with a fixed cross-sectional area. As is known in the art of compressor pulsation control, a given filter bottle has a Helmholtz response, which depends on the dimensions of its two volumes and the connecting choke tube. The acoustic dimensions and the resulting physical dimensions are determined by acoustic modeling, and depend on the pulsation frequencies to be dampened (controlled).

In the present invention, however, where filter bottle 40 has a multi-conduit choke tube 45, filter bottle 40 is "tunable". That is, the response of filter bottle 40 can be made to vary depending on the compressor operating conditions. This is accomplished by changing the diameter of the choke tube 45, more specifically, by opening and closing its conduits.

In the example embodiment of FIG. 3, one choke tube conduit has a different diameter than the other. One or both conduits can be opened or closed using valves 46. The term "valve" is used here in a most general sense to mean any sort of mechanism operable to open and close one end of a conduit.

Figure 4:
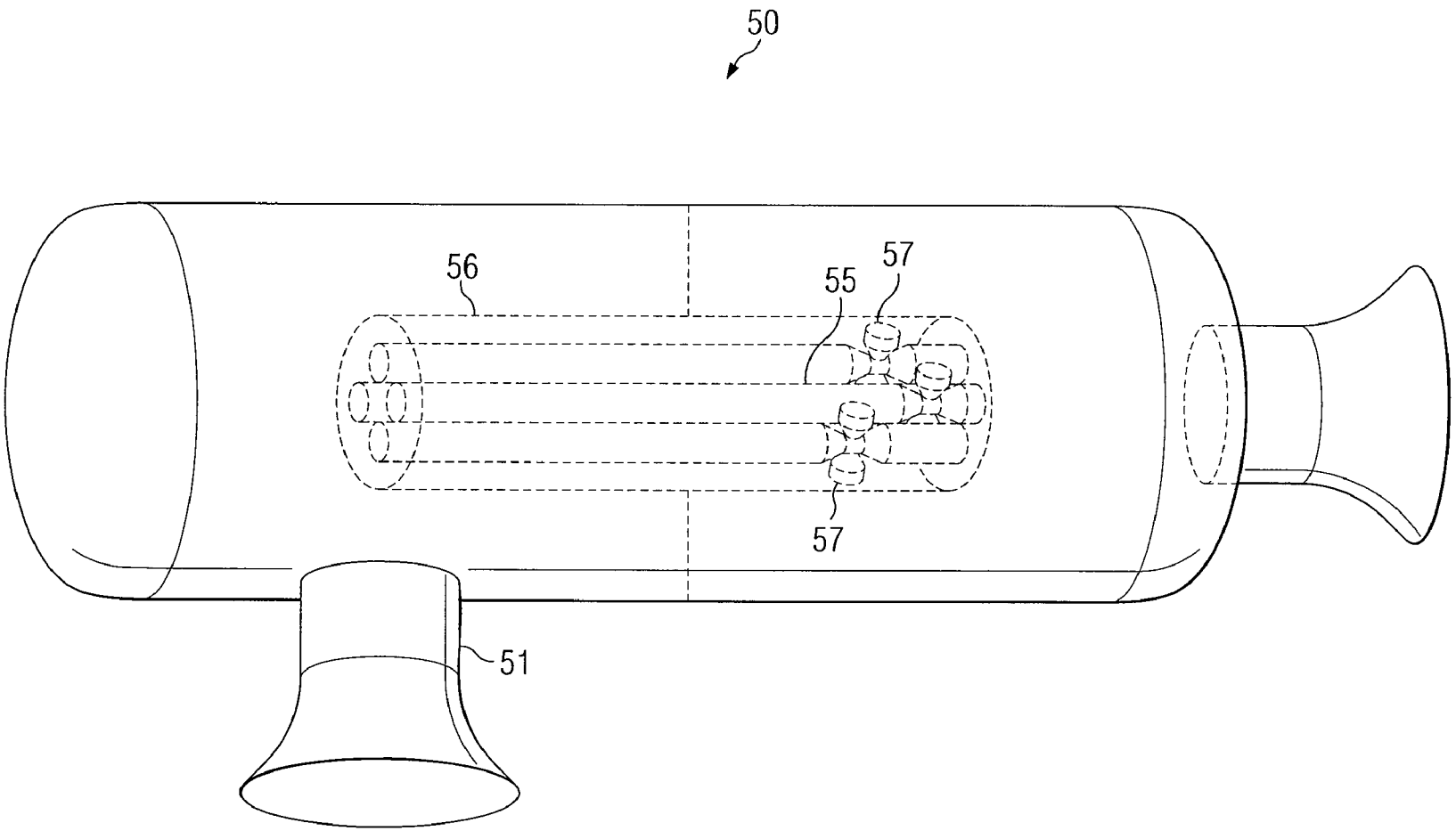
FIG. 4 illustrates the internal elements of a filter bottle having an internal choke tube in accordance with another embodiment of the invention.

FIG. 4 illustrates a second embodiment of a filter bottle 50 having a multi-conduit choke tube 55. The conduits are arranged in a "honeycomb" type design, with the conduits being attached along their axial length. That is, one or more of the conduits may have shared walls. In the example of FIG. 4, choke tube 55 has four conduits 56. Three of the conduits 56 have a valve 57 at their input end. A "primary" conduit, used at the lowest compressor operating speed, need not have a valve. Each of the other conduits is a "secondary" conduit, which may be opened or closed by means of its associated valve 57.

One conduit of choke tube 55 is open at the lower operating speeds of the compressor. As the compressor increases speed, the first order excitation frequency increases. In response, the effective diameter of choke tube 55 is increased by opening additional conduits, using valves 57. The conduits can be incrementally opened as the compressor speed increases. In this manner, the filter bottle response (its filtered frequency) tracks the compressor operation. At the high end of the compressor speed range, the filter frequency may be increased to allow for a larger choke tube diameter. The larger diameter reduces the differential pressure losses in the volume-choke-volume filter.

Referring to both FIGS. 3 and 4, the same concepts apply to various designs of multiple conduits, and the choke tube can have any number of conduits. Each conduit or subset of conduits could be matched to a specific operating speed of the compressor.

In still other embodiments, a single choke tube could be used, but made of a material that can expand or contract to provide a variable cross sectional area of the choke tube. Embodiments of this nature, used in connection with side branch absorbers, are discussed below in connection with FIGS. 9 and 10.

Figure 5:
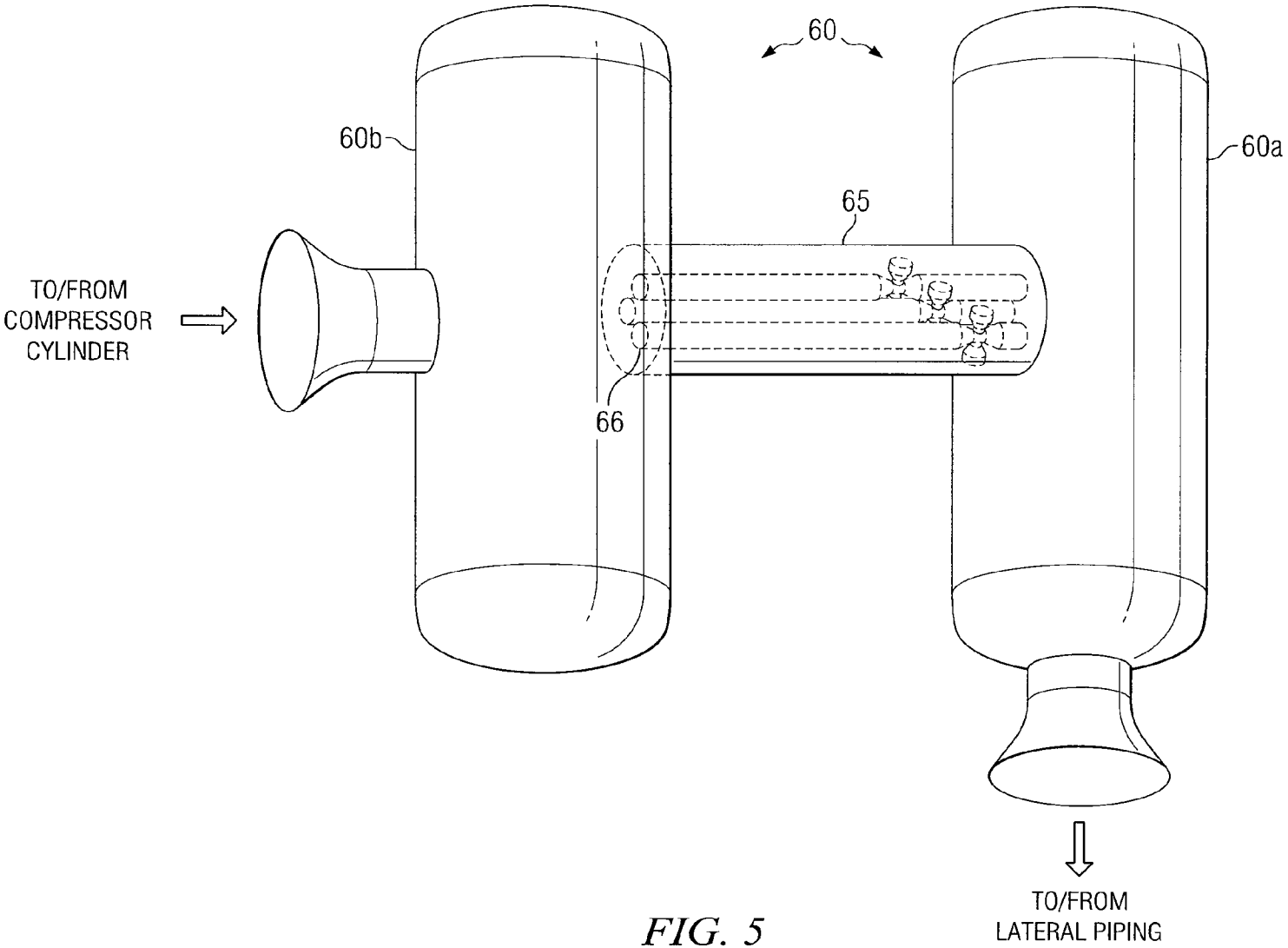
FIG. 5 illustrates a filter bottle having a multi-conduit external choke tube.

FIG. 5 illustrates a filter bottle 60 having an external choke tube 65. Filter bottle has two volumes 60*a* and 60*b* and choke tube 65 operates in a manner similar to the choke tubes of FIGS. 3 and 4. In the example of FIG. 5, choke tube 65 is a multi-conduit choke tube like that of FIG. 4, but it could alternatively have conduits that are physically separate (like those of FIG. 3) or it could be a variable cross-sectional area choke tube. As indicated, filter bottle 60 can be either a suction-side or discharge-side filter bottle, and choke tube 65 has valves (not shown) for opening and closing its conduits 66.

Figure 6:
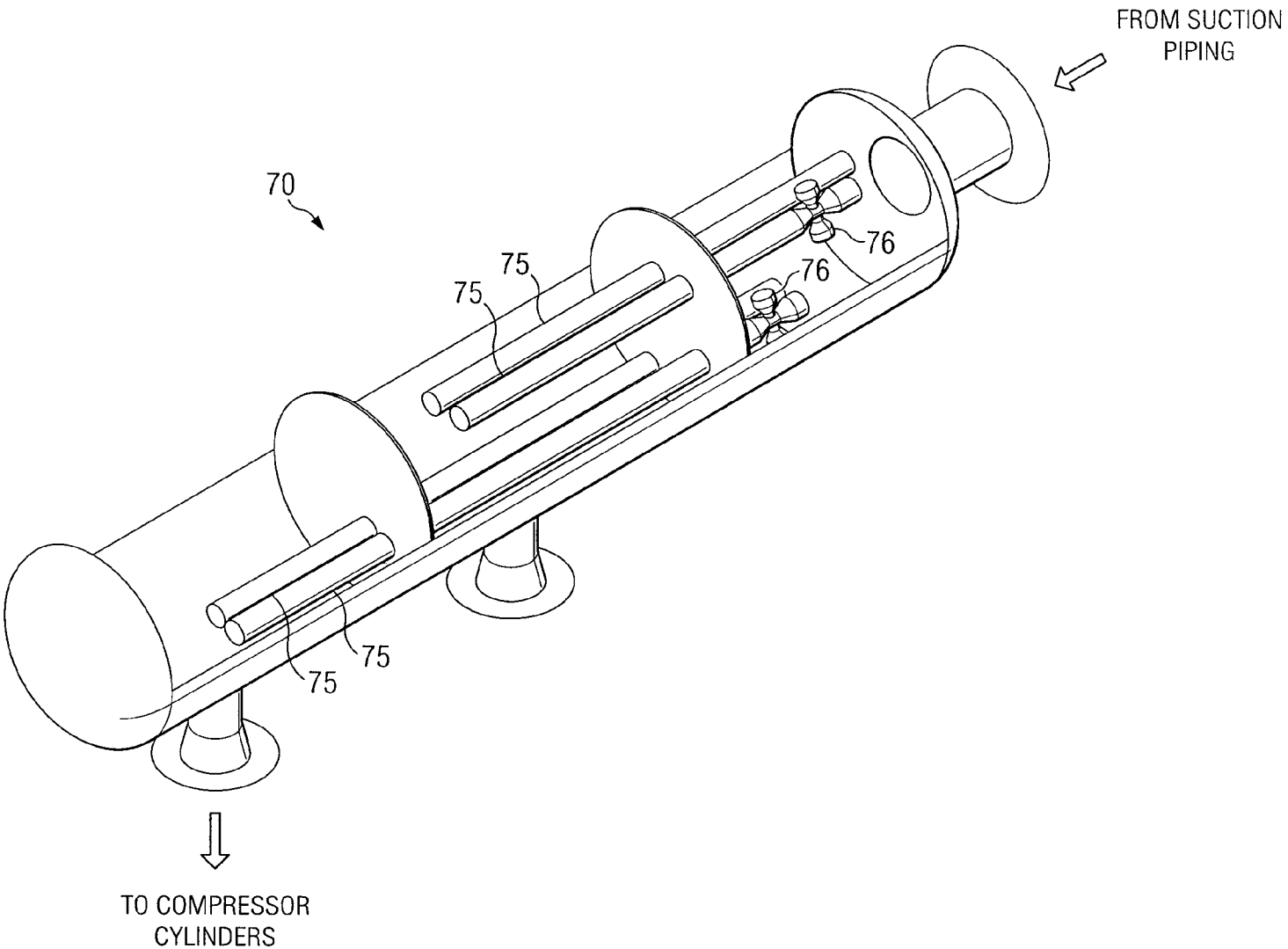
FIG. 6 illustrates the internal elements of a filter bottle serving two cylinders and having multiple volume-choke-volume components.

FIG. 6 illustrates a filter bottle 70, which is like the filter bottle of FIG. 3 except that it serves two cylinders. It should be understood that above-described tunable choke tube concepts could be applied to filter bottles having any number of volumes, each pair of volumes having a tunable choke tube (multi-conduit or variable cross-section) in accordance with the invention. For modern reciprocating compressors, a tunable choke tube may be installed for each gas compressor cylinder and corresponding volume-choke-volume components.

Thus, in FIG. 6, filter bottle 70 has a volume-choke-volume for each cylinder. A multi-conduit choke tube 75 serves each volume-choke-volume, and has a valve 76 that operates to open or close one of the conduits.

Tunable Choke Tube for Side Branch Absorbers

As stated above, side branch absorbers may be placed at various locations within compressor system 100 and its associated piping. Examples, described in the patent applications referenced above, are side branch absorbers ported into lateral piping, a cylinder nozzle, or a manifold. In the figures described below, the side branch absorbers are illustrated in the generalized context of a port into a "surface" which may be the side of piping, a cylinder nozzle, a manifold housing, or any other surface that contains a gas volume or flow.

Figure 7:
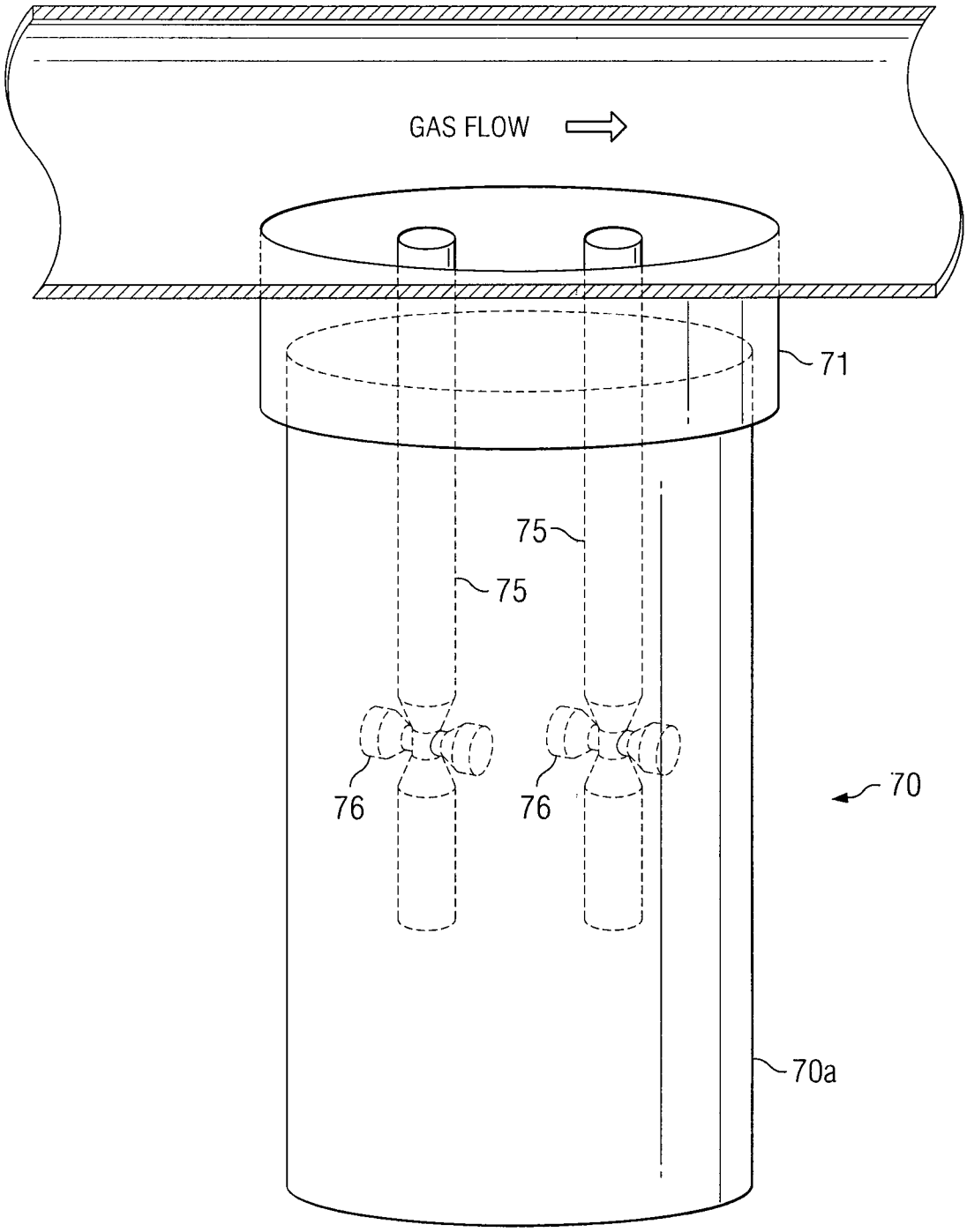
FIG. 7 illustrates a side branch absorber having a multi-conduit internal choke tube.

FIG. 7 illustrates a side branch absorber 70 having a multi-conduit internal choke tube 75. Side branch absorber 70 comprises a rigid housing 70*a* for a gas volume in fluid communication with a "surface" of piping or a gas volume as described above, via choke tube 75.

Choke tube 75 has a plurality of conduits. In the example of this description, choke tube 75 has two conduits, but the concepts described herein could be extended to any number of choke tube conduits. The conduits of choke tube 75 may be, but are not necessarily, the same length or diameter.

The operational principles of choke tube 75 are similar to those of the internal choke tube discussed above in connection with FIG. 3. That is, choke tube 75 results in side branch absorber being "tunable". That is, the response of side branch absorber 70 can be made to vary depending on the compressor operating conditions. This is accomplished by changing the diameter of the choke tube 75, more specifically, by opening and closing its conduits. In the example of FIG. 7, the diameter of choke tube 75 is varied by opening or closing valves 76.

Figure 8:
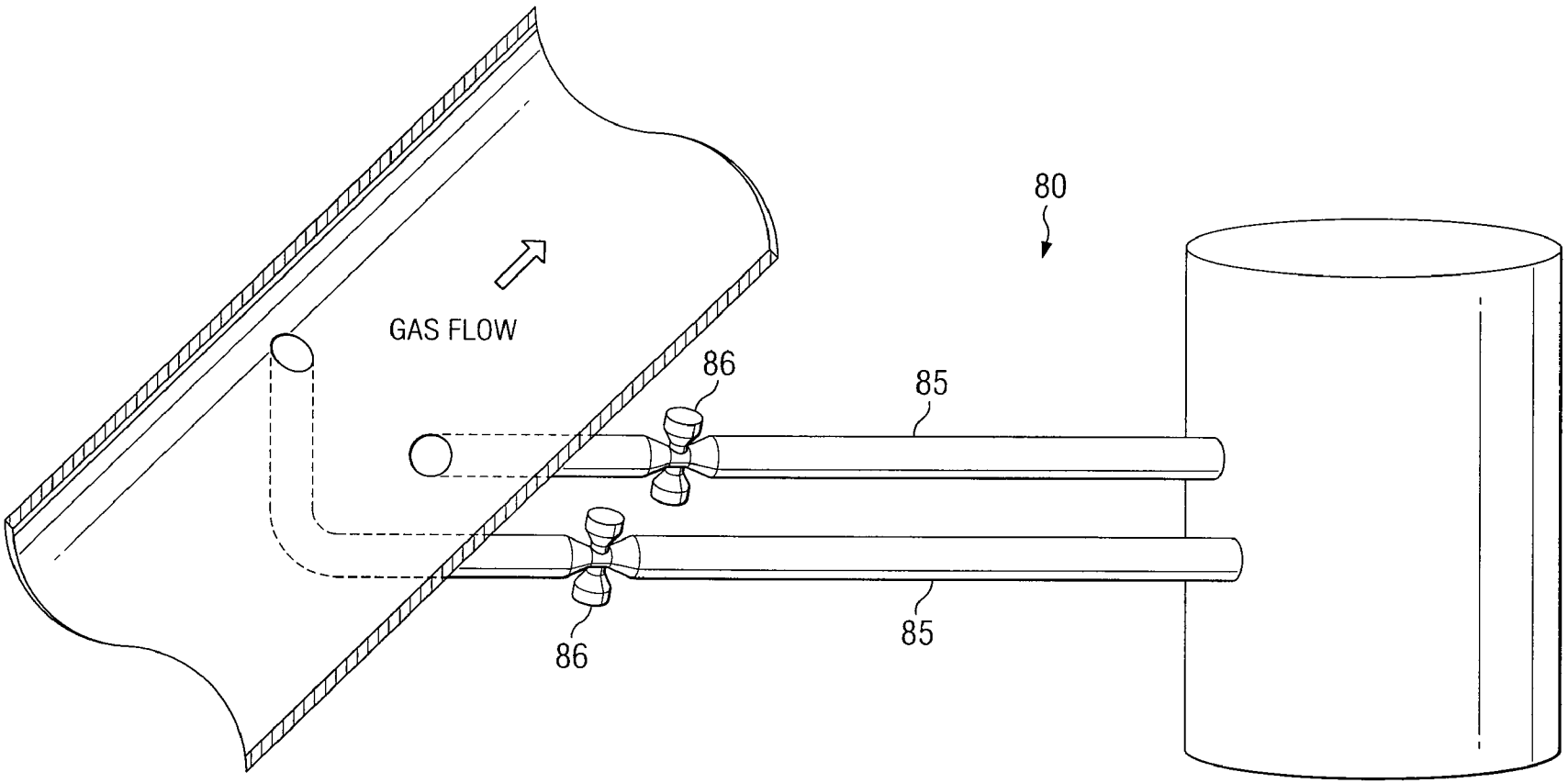
FIG. 8 illustrates a side branch absorber having a multi-conduit external choke tube.

FIG. 8 illustrates a side branch absorber 80 having a multi-conduit external choke tube 85. The structure of choke tube 85 is similar to that used with the filter bottle of FIG. 5. Like other multi-conduit choke tubes described herein, the diameter of the choke tube 85 can be varied by opening or closing valves 86.

As with the choke tubes for filter bottles, the multi-conduit choke tubes 75 and 85 could also have a "honeycomb" type design, sharing conduit walls.

Figure 9B:
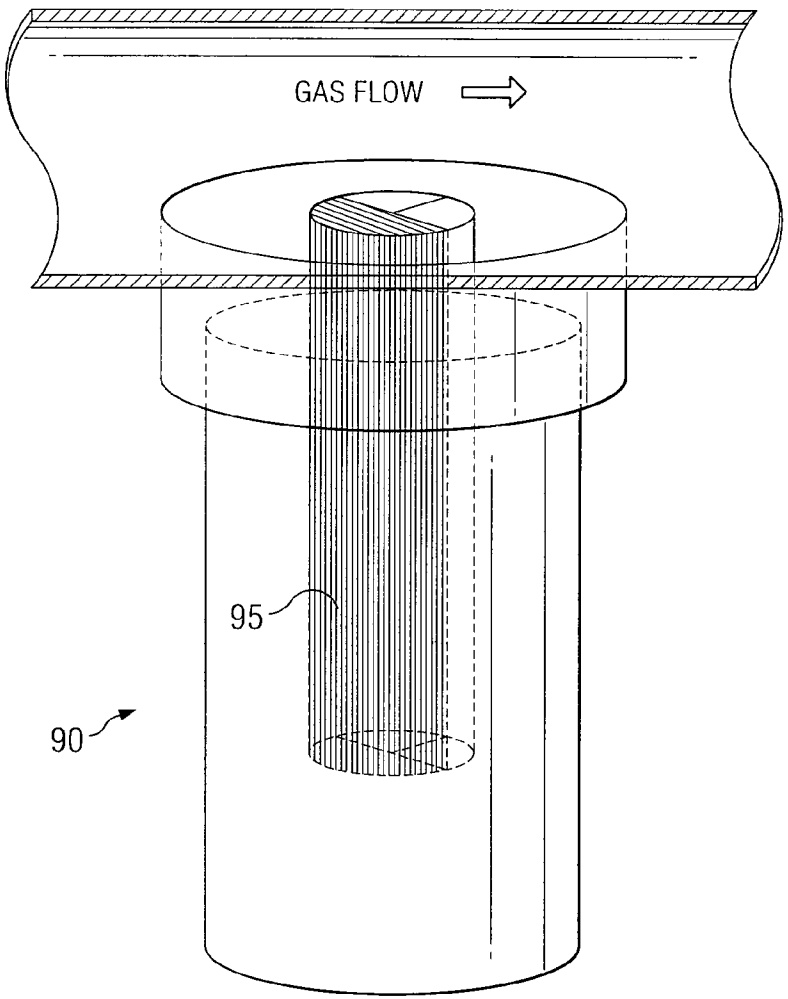
FIGS. 9A and 9B illustrate a side branch absorber having a variable diameter internal choke tube.
Figure 9A:
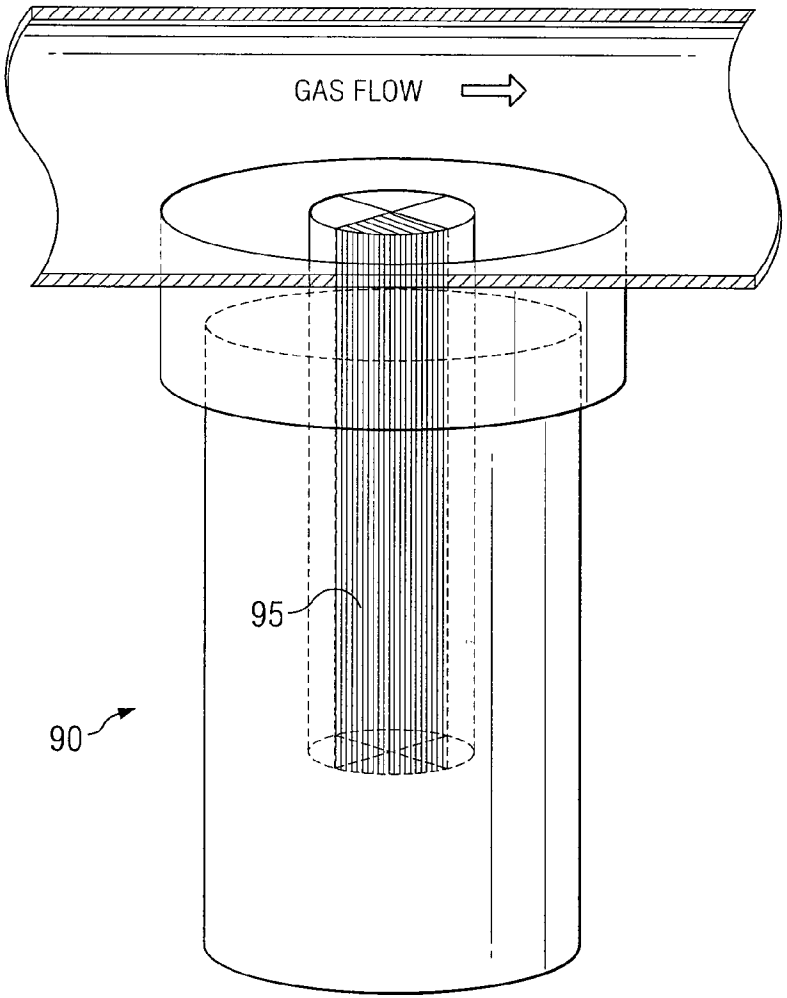

FIGS. 9A and 9B illustrate a side branch absorber 90 having a variable diameter internal choke tube 95. Rather than having multiple conduits, choke tube 95 is made of a material that can expand or contract to provide a variable cross sectional area. The diameter variations may be continuous or incremental. In FIG. 9A, choke tube 95 has a diameter that is smaller than that of FIG. 9B. Although not explicitly illustrated, controller 17 may be used to provide a control signal to activate the diameter variation.

Figure 10A:
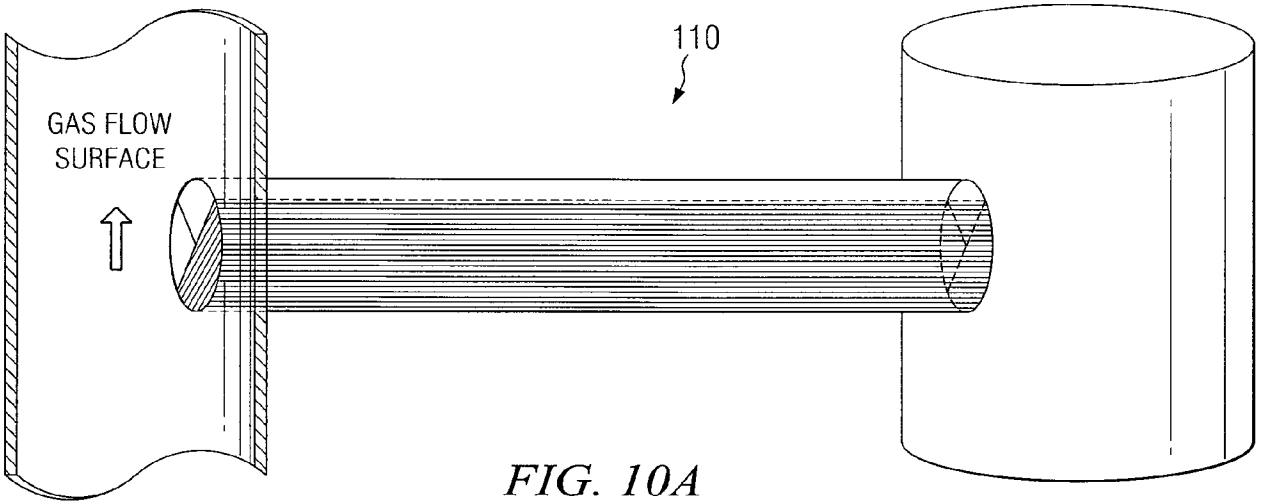
FIGS. 10A and 10B illustrate a side branch absorber having a variable diameter external choke tube.
Figure 10B:
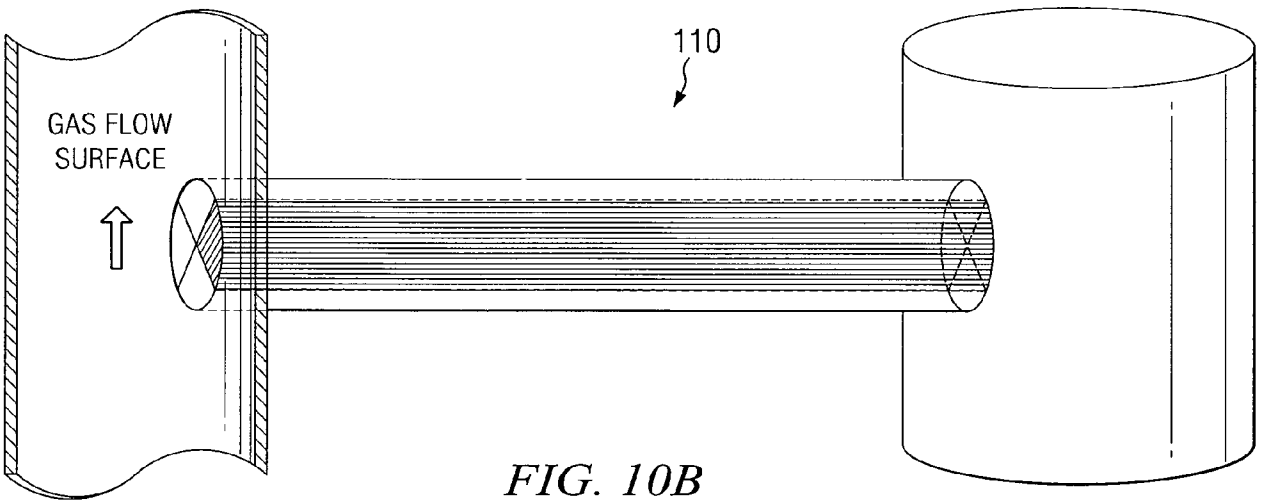

FIGS. 10A and 10B illustrate a side branch absorber 110 having a variable diameter external choke tube 115. As in FIGS. 9A and 9B, the diameter of choke tube 115 can be made to vary. In FIG. 10A, choke tube 95 has a diameter that is larger than that of FIG. 10B.

Choke Tube Operation and Control

The valves of the various multi-conduit choke tubes described herein may be operated manually. Similarly, a choke tube whose cross-sectional area is variable may be manually operated. Alternatively, the choke tube may be operated automatically. For example, the choke tube valves could be operated, or its diameter could vary, in mechanical response to a flow measurement device, or in response to control signals from a controller.

Referring again to FIG. 1, for variable speed compressor systems, controller 17 tracks changing compressor operating conditions, and provides pulsation control optimization for changing pulsation frequencies. In the example of FIG. 1, controller 17 is a comprehensive system control unit, but controller 17 could also a smaller separate controller especially for controlling the diameter of the filter bottle choke tube.

Pulsation values within the system may be measured with one or more vibration sensing devices 19. An example of a suitable sensing device 19 has a tap into the lateral piping and a pressure-to-voltage transducer, which measures dynamic pressure of the flowing gas within the lateral piping. Various measurement devices are known for direct measurement of pulsation within piping. In other embodiments, it may be possible to measure vibration or to infer pulsation changes from changes in other operating conditions.

Data acquisition signals, representing pulsation frequency and/or amplitude, from sensor 19 may be delivered to controller 17. In other embodiments, controller 17 may be programmed to respond simply to changes in compressor speed or flow. Readouts from controller 17 may be used to determine when and how to operate the choke tube, or the data may be used to generate signals for automatic control.

For automatic choke tube control, controller 17 determines control values, and delivers control signals to actuators that adjust the diameter of choke tube 45 or 55. Thus, the pulsation control devices described herein may be self-tuning in the sense that programming of controller 17 causes changes in pulsations to result in changes in the diameter of their choke tubes. Dimension adjustments of the choke tubes are accomplished with appropriate mechanisms, controlled by signals from controller 17.

Controller 17 is equipped with processing and memory devices, appropriate input and output devices, and an appropriate user interface. It is programmed to perform the various control tasks and deliver control parameters to the compressor system. Given appropriate input data, output specifications, and control objectives described herein, algorithms for programming controller 17 may be developed and executed.

As compared to conventional volume-choke-volume filters, the tunable choke tube filters described above provide efficiency advantages. Conventional filters operate at a single cut-off frequency, hence the filter must be designed for the lowest running speed of the compressor. Modern reciprocating compressors operate over a wide speed range, spanning 300-1100 RPM. This relationship between the compressor speed range and the required filter design frequency imposes efficiency losses on the compressor at the higher running speeds.

Furthermore, the tunability of the various choke tubes described herein reduces total differential pressure, which increases the power for gas compression. Differential pressure losses in the filter system are directly related to losses in horsepower and compressor efficiency. High speed compressors may operate more efficiently at the higher end of their speed range due to the increase in the filter choke tube diameter. Additionally, a tunable choke tube can be designed to accommodate smaller filter bottles, which are more cost effective and permit smoother compressor operation.

What is claimed is:

1. A pulsation filter bottle for reducing pulsations associated with a gas compressor system, the compressor system having one or more cylinders connected to lateral piping; the pulsation filter bottle comprising:

a rigid shell having a first port for gas transmission from or into the lateral piping and a second port for gas transmission from or into the cylinders;

wherein the filter bottle is a volume-choke-volume device having at least two volumes separated by a baffle, and a choke tube for providing the only fluid communication between the volumes;

wherein the choke tube has a primary conduit and one or more secondary conduits, each secondary conduit having a valve for opening and closing the secondary conduit, and each secondary conduit being the same length as the primary conduit;

wherein the primary conduit and the one or more secondary conduits are not connected to the first port or second port, are internal to the shell, and are substantially parallel to each other and to the direction of flow of gas through the shell;

wherein each valve may be selectively opened or closed, such that the conduits function as a single choke tube having a variable diameter; and wherein the dimensions of the volumes and the length and diameter of the conduits provide a predetermined acoustic response to the pulsations.

2. The filter bottle of claim 1, wherein each conduit is the same diameter.

3. The filter bottle of claim 1, wherein the primary conduit has a valve for opening and closing the primary conduit.

4. The filter bottle of claim 1, wherein the primary and secondary conduits are axially connected.

5. The filter bottle of claim 1, wherein the primary and secondary conduits are physically separate.

6. A pulsation filter bottle for reducing pulsations associated with a gas compressor system, the compressor system having one or more cylinders connected to lateral piping; the pulsation filter bottle comprising:

a first rigid shell having a first port for gas transmission from or into the lateral piping and having a first volume;

a second rigid shell having a second port for gas transmission from or into the cylinders and having a second volume;

an external choke tube for providing the only fluid communication between the first volume and the second volume;

wherein the choke tube is not connected to the first port or the second port;

wherein gas flow through the pulsation device is only through the choke tube;

wherein the choke tube has a straight primary conduit and one or more straight secondary conduits substantially parallel to the primary conduit, each secondary conduit having a valve for opening and closing the conduit, and each secondary conduit being the same length as the primary conduit;

wherein each valve may be selectively opened or closed, such that the conduits function as a single choke tube having a variable diameter; and wherein the dimensions of the volumes and the length and diameter of the choke tube provides a predetermined acoustic response to the pulsations.

* * * * *